US008655206B2

(12) United States Patent
Kobayashi et al.

(10) Patent No.: US 8,655,206 B2
(45) Date of Patent: Feb. 18, 2014

(54) IMAGE FORMING APPARATUS AND IMAGE FORMING METHOD

(75) Inventors: Shinya Kobayashi, Kanagawa (JP); Tadashi Kasai, Kanagawa (JP); Yoshihiro Sonohara, Kanagawa (JP); Masakazu Terao, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 209 days.

(21) Appl. No.: 13/298,692

(22) Filed: Nov. 17, 2011

(65) Prior Publication Data

US 2012/0134696 A1 May 31, 2012

(30) Foreign Application Priority Data

Nov. 29, 2010 (JP) ..... 2010-265180
Oct. 7, 2011 (JP) ..... 2011-223078

(51) Int. Cl.
*G03G 15/01* (2006.01)

(52) U.S. Cl.
USPC ..... 399/40

(58) Field of Classification Search
USPC ..... 399/39, 40, 53, 54
See application file for complete search history.

(56) References Cited

U.S. PATENT DOCUMENTS

2011/0103811 A1* 5/2011 Tamaki ..... 399/40
2011/0206429 A1 8/2011 Terao et al.

FOREIGN PATENT DOCUMENTS

JP 5-265287 10/1993
JP 2007-155963 6/2007
JP 2009-300960 12/2009

* cited by examiner

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

An image forming apparatus which transfers clear toner and at least one of cyan, magenta, yellow, and black color toner onto a recording medium to form an image based on image information and image classification information, the apparatus including a clear priority determiner configured to determine a clear priority based on the image classification information; a toner adherence amount determiner determining amounts of the color toners and the clear toner to be adhered to the recording medium based on the image information and the clear priority; and a toner transferer transferring the color toners and the clear toner onto the recording medium in amounts determined by the toner adherence amount determiner.

8 Claims, 6 Drawing Sheets

| IMAGE CLASSIFICATION ID | IMAGE CLASSIFICATION | CLEAR PRIORITY |
|---|---|---|
| 001 | SECURITY LETTER | 1 |
| 002 | BARCODE INFORMATION | 1 |
| 003 | WATERMARK IMAGE | 0 |
| 004 | BACKGROUND PATTERN | −1 |
| 005 | PAPER DESIGN | −1 |

IMAGE FORMING APPARATUS AND IMAGE FORMING METHOD

CROSS-REFERENCE TO RELATED APPLICATIONS

This patent application is based on and claims priority pursuant to 35 U.S.C. §119 to Japanese Patent Applications Nos. 2010-265180 and 2011-223078, filed on Nov. 29, 2010 and Oct. 7, 2011, respectively in the Japanese Patent Office, the entire disclosure of which is hereby incorporated by reference herein.

FIELD OF THE INVENTION

The present invention relates to an image forming apparatus which transfers at least one of a clear toner, a cyan toner a magenta toner, a yellow toner and a black toner to a recording medium to form an image, based on image information and image classification information.

BACKGROUND OF THE INVENTION

Typically, a total amount of toner an electrophotographic image forming apparatus can transfer or fix onto a recording medium such as paper or the like is known to have a limit. Amounts of toner transferred beyond that limit cause defective fixation or transfer.

Under-color removal, which reduces cyan (C) toner, magenta (M) toner, and yellow (Y) toner and replaces them with black (K) toner, is known as a method of reducing the total amount of toner. However, when the C toner, M toner, and Y toner are reduced, image quality deteriorates.

Japanese published unexamined application No. 5-265287 (JP-H05-265287-A) discloses reducing the clear toner without reducing the C toner, M toner and Y toner to reduce the total amount of toner.

However, when security letters and barcodes are formed with the clear toner, they cannot be identified if the clear toner is reduced as JP-H05-265287-A discloses. On the other hand, when the clear toner is reduced in printed images including background patterns and paper designs formed of the clear toner, there is no serious problem because they are visually identifiable. In this case, it is preferable to precisely reproduce colors without reducing the color toners. Namely, it is necessary to determine whether to clarify images formed of clear toner or precisely reproduce image colors formed of color toners, based on image classification. However, JP-H05-265287-A does not disclose such image classification-based control.

Accordingly, a need exists for an image forming apparatus capable of determining whether to clarify images formed of the clear toner or precisely reproduce image colors formed of color toners, based on image classification.

SUMMARY OF THE INVENTION

Accordingly, an object of the present invention is to provide an image forming apparatus capable of determining whether to clarify images formed of the clear toner or precisely reproduce image colors formed of color toners, based on image classification.

Another object of the present invention is to provide an image forming program using the image forming apparatus.

These objects and other objects of the present invention, either individually or collectively, have been satisfied by the discovery of an image forming apparatus which transfers at least one of a cyan color toner, a magenta color toner, a yellow color toner and a black color toner, and a clear toner onto a recording medium to form an image, based on information of an image and a classification thereof, wherein the image forming apparatus comprises:

a clear priority determiner configured to determine a clear priority, based on the classification, a toner adherence amount determiner configured to determine adherence amounts of the color toners and the clear toner, based on the information of an image and the clear priority, and a toner transferer configured to transfer the color toner and the clear toner onto the recording medium in amounts determined by the toner adherence amount determiner.

These and other objects, features and advantages of the present invention will become apparent upon consideration of the following description of the preferred embodiments of the present invention taken in conjunction with the accompanying drawings.

DETAILED DESCRIPTION OF THE INVENTION

The present invention provides an image forming apparatus capable of determining whether to clarify images formed of the clear toner or precisely reproduce image colors formed of color toners, based on image classification.

More particularly, the present invention relates to an image forming apparatus which transfers at least one of a cyan color toner, a magenta color toner, a yellow color toner and a black color toner, and a clear toner onto a recording medium to form an image, based on information of an image and a classification thereof, wherein the image forming apparatus comprises:

a clear priority determiner configured to determine a clear priority, based on the classification, a toner adherence amount determiner configured to determine adherence amounts of the color toners and the clear toner, based on the information of an image and the clear priority, and a toner transferer configured to transfer the color toner and the clear toner onto the recording medium in amounts determined by the toner adherence amount determiner.

Figure 1:
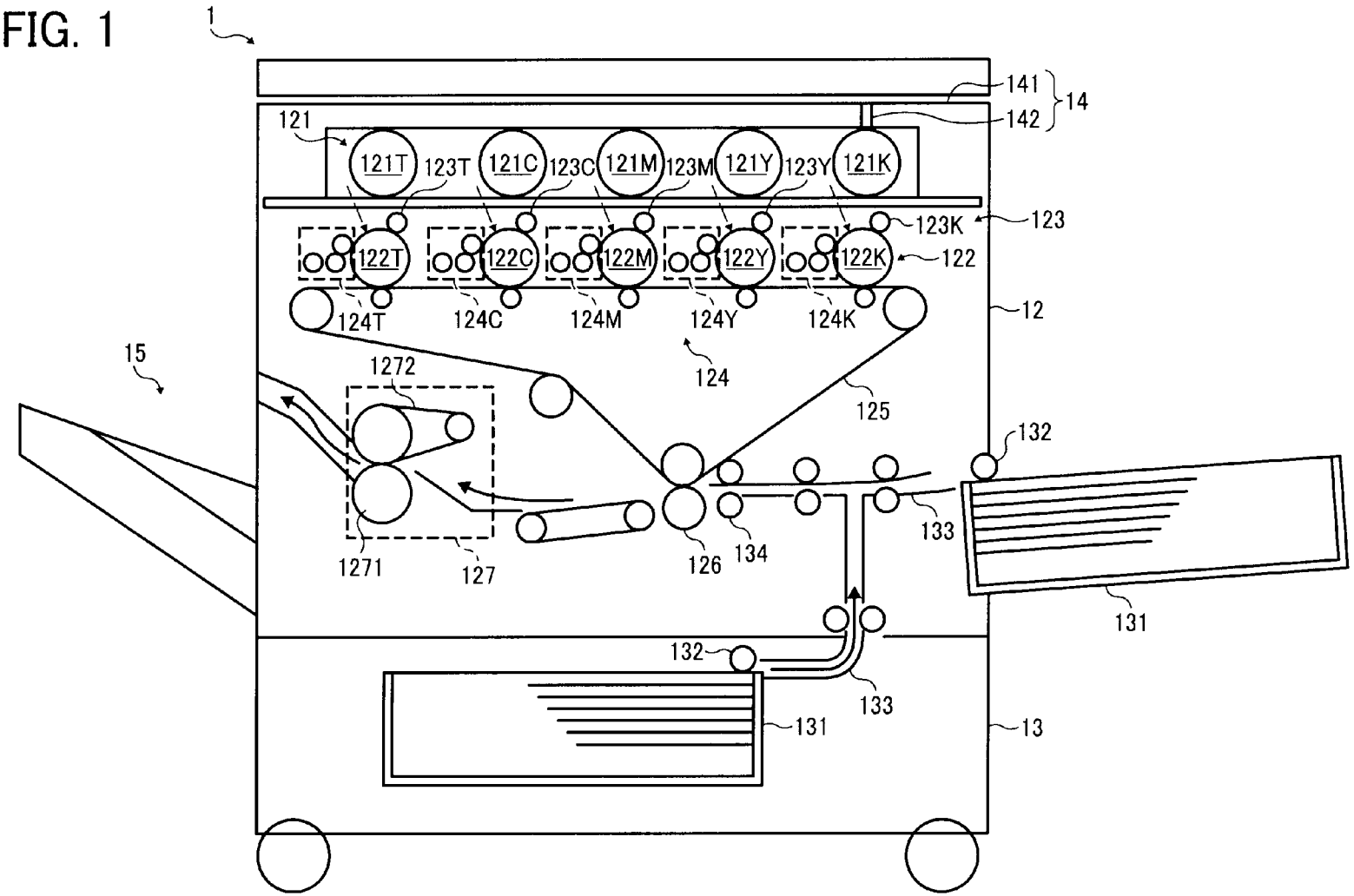
FIG. 1 is a hardware configuration of an image forming apparatus 1.

The image forming apparatus 1 of the present invention includes a printer 12, a paper feeder 13, a scanner 14, a paper discharger 15 as FIG. 1 shows, and a controller 10 which is not shown in FIG. 1.

Figure 2:
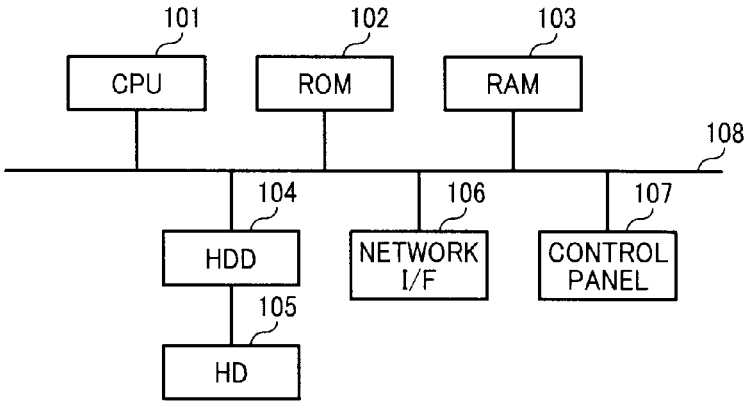
FIG. 2 is a hardware configuration of a controller 10 of the image forming apparatus 1.

First, a hardware configuration of the controller 10 is explained, referring to FIG. 2.

The controller 10 includes a CPU (Central Processing Unit) 101, a ROM (Read Only Memory) 102, a RAM (Random Access Memory) 103, a HDD (Hard Disk Drive) 104, a HD (Hard Disk) 105, a network I/F (Interface) 106, an operation display panel 107, and a pass line 108.

The CPU 101 executes an image forming program for forming an image. A system activating program information, etc. is stored in the ROM 102. The RAM 103 is used as an area for the program executing work of the CPU 101. The HDD 104 controls reading out various data from or writing them in the HD 105. The HD 105 is a memory memorizing data, and substitutable with outer memories such as CD-ROM (Compact Disk Read Only Memory), CD-R (Compact Disk Recordable) and DVD (Digital Versatile Disk). The network I/F 106 transmits various information to and receives it from outer devices such as an image processor 2, and the operation display panel 107 receives an operation entry. The pass line 108 connects the above-mentioned devices.

A program memorized in the ROM 102 may be recorded with an installable or executable file in a computer-readable recording medium such as CD-ROMs, CD-Rs and DVDs.

The hardware configuration printer 12 in FIG. 1 is explained.

The printer 12 includes a cartridge 121, a photoreceptor drum 122, a charger 123, an image developer 124, an intermediate transfer belt 125, a second transfer roller 126, a fixer 127, etc. The fixer 127 includes a pressure roller 1271 and a fixing belt 1272. The printer 12 an embodiment of toner adherence means.

The cartridge 121 contains a cyan (C), a magenta (M), a yellow (Y) and a black (K) toner, and a clear (T) toner, and includes five cartridges for each toner 121C, 121M, 121Y, 121K and 121T. Hereinafter, any one of the cartridges 121C, 121M, 121Y, 121K and 121T is referred to as a cartridge 121.

The clear toner of the present invention is a transparent toner and is formed of a resin which does not include a colorant.

The surface of the photoreceptor drum 122 is uniformly charged by the charger 123, and an electrostatic latent image is formed thereon based on image information from the controller 10. Further, the image developer 124 transfers a toner onto the electrostatic latent image to form an image. The photoreceptor drum 122 includes five photoreceptor drums 122C, 122M, 122Y, 122K and 122T for each toner C. M, Y, K and T. Hereinafter, any one of the cartridges 122C, 122M, 122Y, 122K and 122T is referred to as a photoreceptor drum 122.

Based on a color toner adherence amount and a clear toner adherence amount determined by a toner adherence amount determiner 113, the charger 123 contacts the photoreceptor drum 122 to uniformly charge the surface thereof when applied with a voltage. The charger 123 includes five photoreceptor drums 123C, 123M, 123Y, 123K and 123T for each toner C. M, Y, K and T. Hereinafter, any one of the cartridges 123C, 123M, 123Y, 123K and 123T is referred to as a charger 123.

The image developer 124 transfers a toner in the cartridge 121 onto the surface of the photoreceptor drum 122 charged by the charger 123 to form a toner image thereon. The image developer 124 includes five photoreceptor drums 124C, 124M, 124Y, 124K and 124T for each toner C. M, Y, K and T. Hereinafter, any one of the cartridges 124C, 124M, 124Y, 124K and 124T is referred to as an image developer 124.

The toner image on the photoreceptor drum 122 is transferred onto the intermediate transfer belt 125 while travelling and contacting to the photoreceptor drum.

The second transfer roller 126 sandwiches a recording medium fed from the paper feeder 13 with the intermediate transfer belt 125 to transfer the toner image thereon onto the recording medium, and feeds the recording medium on which the toner image is transferred to the fixer 127.

The fixer 127 fixes the toner image on the recording medium fed by the second transfer roller 126, and includes a pressure roller 1271, a fixing belt 1272, etc. The pressure roller 1271 presses the recording medium to the fixing belt 1272 such that the toner image is heated to fix on the recording medium.

The paper feeder 13 feeds the recording medium such as papers to the printer 12, and includes a paper feed tray 131, a paper feed roller 132, a paper feed belt 133 and a registration roller 134.

The paper feed tray 131 contains the recording medium such as papers. The paper feed roller 132 takes out the papers contained in the paper feed tray 131 and places them on the paper feed belt 133. The paper feed belt 133 put the papers into the registration roller 134. The registration roller 134 feeds the papers put in by the paper feed belt 133 between the intermediate transfer belt 125 and the second transfer roller 126.

The scanner 14 reads out image information drawn on papers, etc., and includes a contact glass 141 and a read sensor 142. The papers image information is drawn on are placed on the contact glass 141. The read sensor 142 reads out the image information drawn on the papers placed on the contact glass 141.

The paper discharger 15 discharges the recording medium an image is fixed on by the fixer 127 and stores the discharged recording medium.

Figure 3:
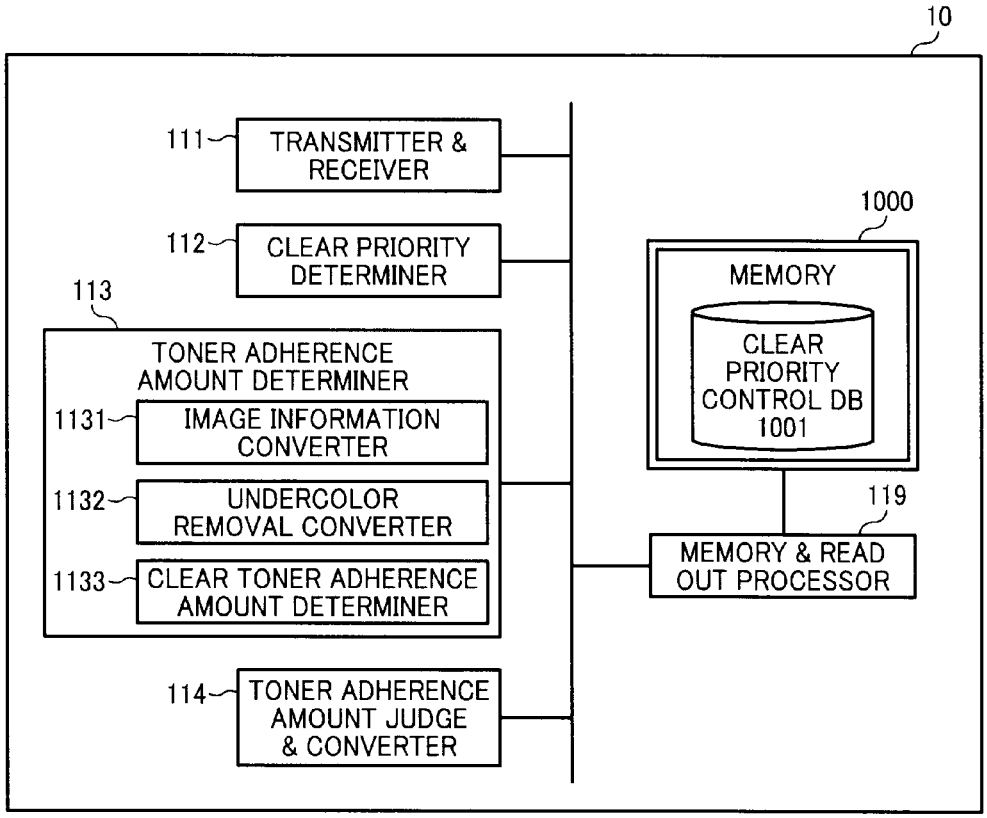
FIG. 3 is a functional configuration of the controller 10 of the image forming apparatus 1.

FIG. 3 is a functional configuration of the controller 10. As FIG. 3 shows, the controller 10 includes a transceiver 111, a clear priority determiner 112, and a toner adherence amount determiner 113, a toner adherence amount judge and converter 114 and memory and read out processor 119. In addition, the toner adherence amount determiner 113 includes an image information converter 1131, an under color removal converter 1132 and a clear toner adherence amount determiner 1133. These are function or means effective when any one of the configurations in FIG. 2 is activated by the order of the CPU 101 according to a program memorized in the ROM 102. Further, the controller 10 includes a memory 1000 formed of the ROM 102 and the HD 105.

The transceiver 111 receives the image information and the image classification information effective by the network I/F 106 in FIG. 2 and transmitted from an information processor, etc. The image information represents an image formed on a recording medium such as papers, using an electrical color separation image signal presenting each red (R), green (G) and blue (B) color. The image classification information represents classification of images such as background patterns, security letters, barcodes, etc. Further, the transceiver 111 is an example of information receiving means.

The clear priority determiner 112 determines a value extracted from clear priority control DB 1001 mentioned later by the memory and read out processor 119 based on the image classification information as a clear priority k. The clear priority k is a degree that the clear toner is used when images are formed and is a real number from −1 to 1. The higher the clear priority k, the more the clear toner and the less the color toners transferred to the paper by the image forming apparatus 1. By contrast, the lower the clear priority k, the less the clear toner and the more the color toners the image forming apparatus 1 transfers to a paper. Further, the clear priority determiner 112 is an example of clear priority determining means.

The toner adherence amount determiner 113 determines each color toner adherence amount Vc, Vm, Vy and Vk for each C, M, Y and K color, and a clear toner adherence amount Vt, based on the image information the transceiver 111 receives. The color toner adherence amount is an amount of the color toner adhering to the recording medium to form each pixel, and a ratio of an area the color toner adheres to an area of a pixel. The clear toner adherence amount Vt is an amount of the clear toner adhering to each pixel formed of the color toners on the recording medium to gloss the pixel, and a ratio of an area the clear toner adheres to an area of a pixel.

The image information converter 1131 included in the toner adherence amount determiner 113 executes a color space conversion process, etc. to convert the image information formed of electrical color separation signals presenting red (R), green (G) and blue (B) colors into color toner adherence amounts VcO, VmO and VyO for C, M and Y color toners, respectively. The under color removal converter 1132 included in the toner adherence amount determiner 113 executes under color removal (UCR=Under Color Removal) conversion to the VcO, VmO and VyO to be converted into color toner adherence amounts Vc, Vm, Vy and Vk for C, M, Y and K colors needed to reproduce a color tone presented by the image information.

The clear toner adherence amount determiner 1133 included in the toner adherence amount determiner 113 determines a clear toner adherence amount Vt based on the color toner adherence amounts Vc, Vm, Vy and Vk converted by the image information converter 1131 and the under color removal converter 1132.

When the color toner adherence amounts Vc, Vm, Vy and Vk and the clear toner adherence amount Vt determined by the toner adherence amount determiner 113 adhere to a paper, an image satisfying color reproducibility and glossiness can be formed. However, total amount of the color toner and the clear toner is occasionally too much. The toner adherence amount judge and converter 114 converts the adherence amounts of the color toner and the clear toner such that the total amount of the color toner and the clear toner is not over the predetermined toner adherence amount limit Max.

The toner adherence amount judge and converter 114 executes a calculation based on the clear priority k determined by the clear priority determiner 112 to convert the color toner adherence amounts Vc, Vm, Vy and Vk and the clear toner adherence amount Vt determined by the toner adherence amount determiner 113 into color toner adherence amounts Vc', Vm', Vy' and Vk' and a clear toner adherence amount Vt' the image forming apparatus 1 transfers to a paper. Each of the toner adherence amount determiner 113 and the toner adherence amount judge and converter 114 is an example of toner adherence amount determining means.

The memory and read out processor 119 memorizes various information in a memory 1000 formed of the ROM 102 and HD 105 and reads out various information memorized therein in FIG. 3. A clear priority control DB (Data Base) 1001 formed of a clear priority control table is constituted in the memory 1000. Further the memory 1000 memorizes the total toner adherence amount limit Max presenting the maximum limit of the total amount of the color toner adherence amounts Vc, Vm, Vy and Vk for C, M, Y and K colors and the clear toner adherence amount Vt. The memory 1000 is an example of memorizing means.

Figures 4, 5:
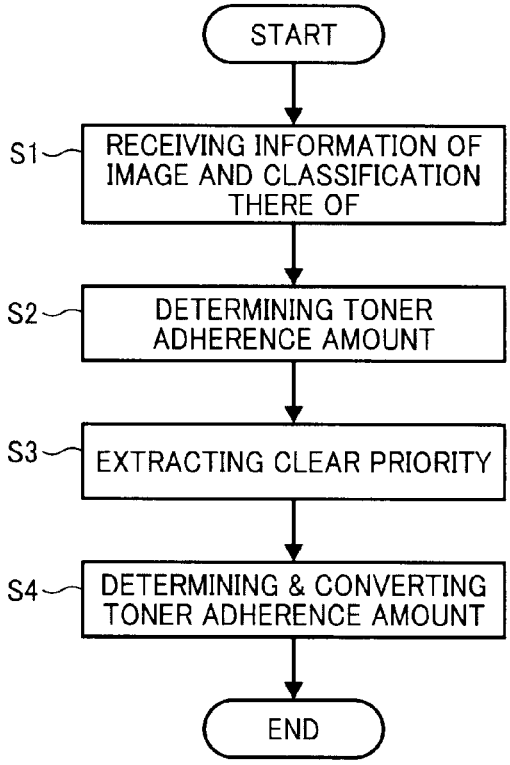
FIG. 4 is a conceptual diagram showing clear priority control table.
FIG. 5 is a process flow diagram of the controller 10 of the image forming apparatus 1.

The clear priority control table controls image classification names and the clear priority k presenting the degree that the clear toner is preferentially used in relation to each other per image classification ID which is the image classification information. For example, an image data control table in FIG. 4 shows an image classification name "security letter" and a clear priority "1" are memorized for an image classification ID "001".

The clear priority k is a value previously memorized in the clear priority control DB relevant to the image classification ID and the image classification name. The higher the clear priority k, the more the clear toner and the less the color toner the image forming apparatus 1 transfers to a paper. The lower the clear priority k, the less the clear toner and the more the color toner the image forming apparatus 1 transfers to a paper. In the present invention, the maximum value of the clear priority k is 1, and the minimum value thereof is −1.

The image classification names include background patterns and paper designs formed on total images, anticounterfeit security letters, barcodes, etc. When the image classification name is a background pattern, the background pattern is formed by the clear toner. When the image classification name is a paper design, the paper design is formed by the clear toner. Even when a background pattern or a paper design is partially unclear, most of the background pattern or the paper design can visually be identified. Namely, the clear toner can be reduced. Therefore, for the image classification names such as background patterns and paper designs, the clear toner priority k is preferably memorized as −1 to reduce the clear toner adherence amount. In this case, the image forming apparatus 1 reduces the clear toner adherence amount Vt without reducing the color toner adherence amounts Vc, Vm, Vy and Vk for C, M, Y and K colors. Therefore, a color tone of an image formed of C, M, Y and K color toners is not affected.

When the image classification name is a security letter, a letter is formed by the clear toner for the purpose of security. When the image classification name is a barcode, a barcode is formed by the clear toner. When the security letter is partially unclear, the letter could not visually and precisely be read. When the barcode is partially unclear, the barcode could not precisely be read by a barcode reader. Namely, reduction of the clear toner caused a problem. Therefore, for the image classification names such as security letters and barcodes, the clear toner priority k is preferably memorized as 1 such that the clear toner sufficiently adheres. In this case, the image forming apparatus 1 reduces the color toner adherence amounts Vc, Vm, Vy and Vk for C, M, Y and K colors without reducing the clear toner adherence amount Vt. Therefore, the resultant image deteriorates in color density, but has clear gloss.

When the image classification is a clear watermarked image, images formed by the color toners may have some transformation, but need to have sharpness. At the same time, images formed by the clear toner may have slightly lower glossiness, but do not have to completely lose glossiness. The clear watermarked image is a watermarked image formed by the clear toner. For example, it is used as a watermarked image on a bill, and the image can clearly be identified when illuminated. In this case, the clear priority k is preferably a medium value greater than −1 and less than 1. Then, the image forming apparatus 1 slightly reduces the color toner adherence amounts Vc, Vm, Vy and Vk and the clear toner adherence amount Vt together. Therefore, the resultant image slightly changes in color tone and slightly deteriorates in glossiness, but which are both acceptable.

Figure 6:
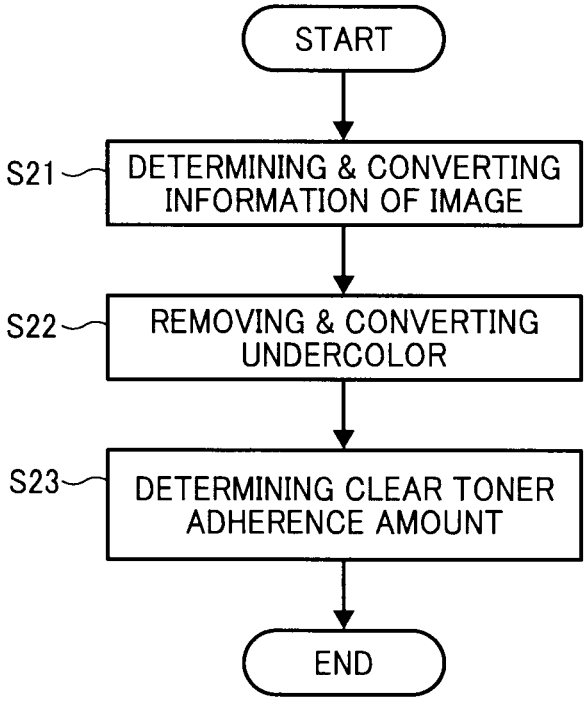
FIG. 6 is a process flow diagram of the controller 10 determining color toner and clear toners adherence amount.
Figure 7:
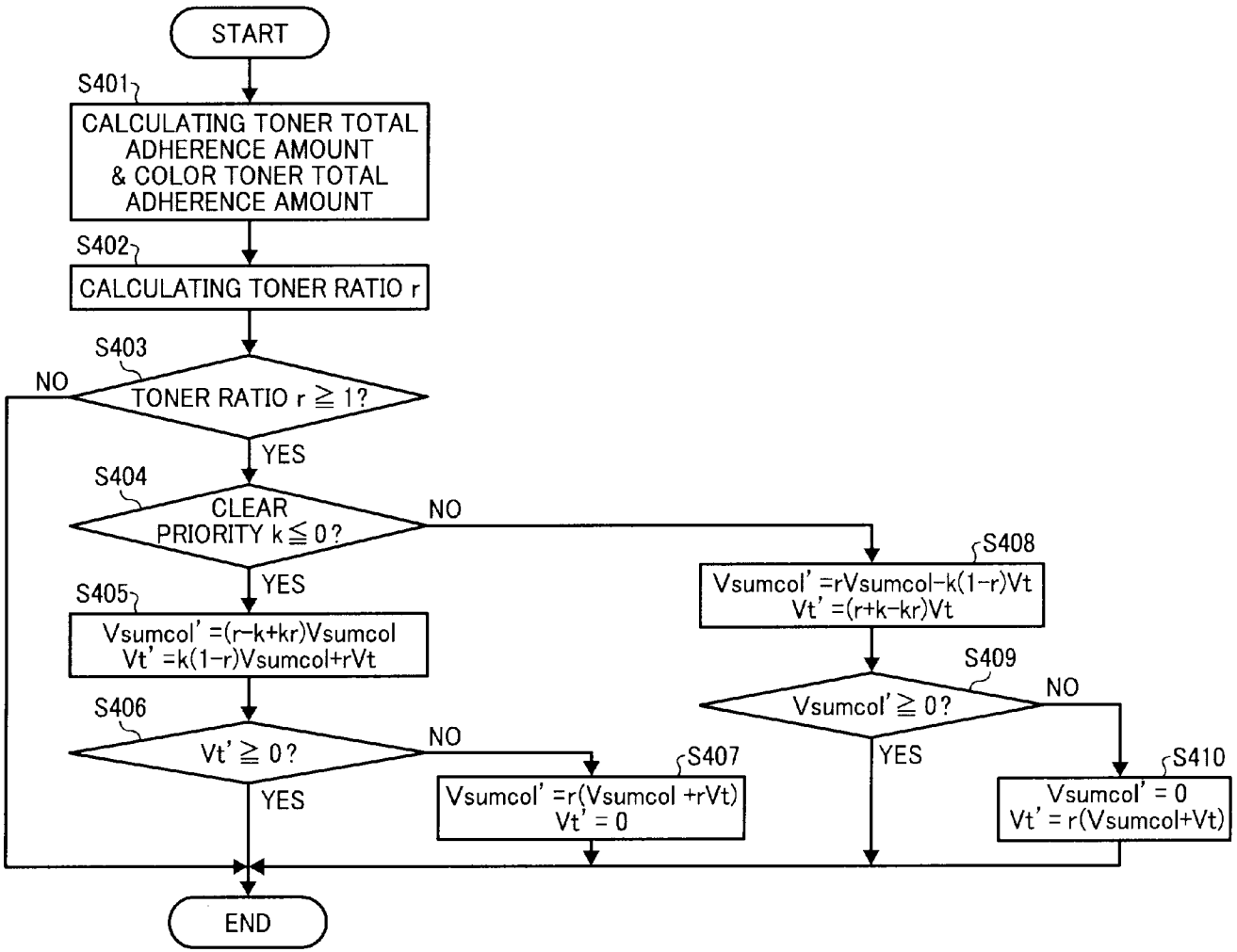
FIG. 7 is a detailed process flow diagram of the controller 10 determining color toner and clear toners adherence amount.
Figure 8:
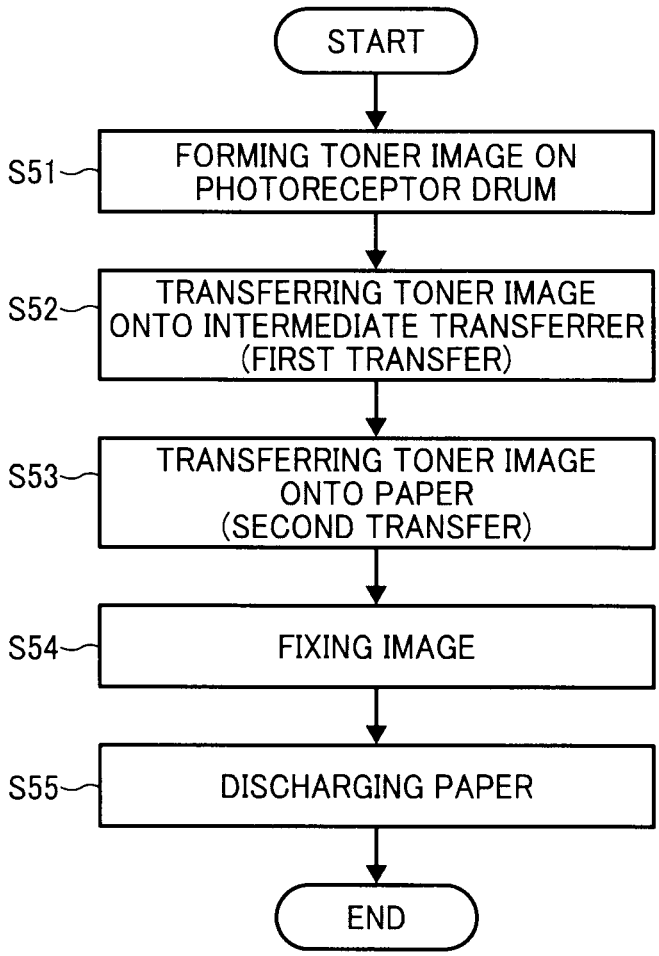
FIG. 8 is a process flow diagram of a printer 12 of the image forming apparatus 1, forming an image.

The process in the image forming apparatus 1 of the present invention is explained, using FIGS. 5 to 8. FIG. 5 is a process flow diagram of the controller 10 of the image forming apparatus 1, FIG. 6 is a process flow diagram of the controller 10 determining color toner and clear toners adherence amount, FIG. 7 is a detailed process flow diagram of the controller 10 determining color toner and clear toners adherence amount and FIG. 8 is a process flow diagram of a printer 12 of the image forming apparatus 1, forming an image.

As FIG. 5 shows, the transceiver 111 receives image information and image classification information transmitted from image processors, etc. through a communication network first (STEP S1).

Next, the toner adherence amount determiner 113 determines each color toner adherence amount Vc', Vm', Vy' and Vk', and a clear toner adherence amount Vt', based on the image information the transceiver 111 receives (STEP S2).

The process the toner adherence amount determiner 113 executes is explained, using FIG. 6. First, the image information converter 1131 converts the image information the transceiver 111 receives into C, M and Y color toner adherence amounts (STEP S21). Specifically, the image information converter 1131 executes processes such as shading corrections, displacement corrections, color space conversions and gamma corrections to the image information to convert the image information into C, M and Y color toner adherence amounts VcO, VmO and VyO. The under color removal converter 1132 executes under color removal conversion to the VcO, VmO and VyO converted by the image information converter 1131 (STEP S22). These processes determine the color toner adherence amounts Vc, Vm, Vy and Vk.

When the image information is converted into the color toner adherence amounts Vc, Vm, Vy and Vk by the image information converter 1131 and the under color removal converter 1132, the clear toner adherence amount determiner 1133 determines the clear toner adherence amount Vt (STEP S23). The clear toner adherence amount determiner 1133 may determine the clear toner adherence amount Vt so as to uniformly transfer the clear toner onto the allover image or not to form convexities and concavities on the surface thereof, based on the color toner adherence amounts Vc, Vm, Vy and Vk.

Meanwhile, the clear priority determiner 112 determines a value read out by the memory and read out processor 119 from the clear priority control DB1001 as a clear priority k with a retrieval key of the image classification ID or the image classification name included in the image classification information the transceiver 111 receives (STEP S3).

Next, based on the clear priority k determined by the clear priority determiner 112, the toner adherence amount judge and converter 114 converts the color toner adherence amounts Vc, Vm, Vy and Vk and the clear toner adherence amount Vt determined by the toner adherence amount determiner 113 into color toner adherence amounts Vc', Vm', Vy' and Vk' and a clear toner adherence amount Vt' (STEP S4).

The details of this process are explained using FIG. 7. As FIG. 7 shows, the toner adherence amount judge and converter 114 calculates a total toner adherence amount Vsumall including the color toner adherence amounts Vc, Vm, Vy and Vk and the clear toner adherence amount Vt determined by the toner adherence amount determiner 113, according to the following formula (STEP S401).

$$Vsumall=Vc+Vm+Vy+Vk+Vt$$

Further, the toner adherence amount judge and converter 114 calculates a total color toner adherence amount Vsumcol including the color toner adherence amounts Vc, Vm, Vy and Vk, according to the following formula (STEP S401).

$$Vsumcol=Vc+Vm+Vy+Vk$$

Next, the memory and read out processor 119 reads out the total toner adherence amount limit Max memorized in the memory 1000. The toner adherence amount judge and converter 114 calculates a ratio r of the total toner adherence amount Vsumall to the total toner adherence amount limit Max (r=Vsumall/Max) (STEP S402) and judges whether the ratio r is not less than 1 (STEP S403). When the ratio is judged to be less than 1 in STEP S403, toner adherence amounts Vc', Vm', Vy', Vk' and Vt' the image forming apparatus transfers to a paper are Vc, Vm, Vy, Vk and Vt determined by the toner adherence amount determiner 113, respectively, and the process is completed.

When the ratio is judged to be greater than 1 in STEP S403, the toner adherence amount judge and converter 114 judges whether the clear priority k determined in STEP S3 is not grater than 0 (STEP S404).

When the clear priority k is not grater than 0 in STEP S404, the toner adherence amount judge and converter 114 converts the toner adherence amounts Vc', Vm', Vy', Vk' and Vt' the image forming apparatus 1 transfers to a paper as follows. First, the toner adherence amount judge and converter 114 calculates a total color toner adherence amount Vsumcol' the image forming apparatus 1 transfers to a paper, based on the following formula using the ratio r and the clear priority k (STEP S405).

$$Vsumcol'=(r-k+kr)Vsumcol$$

Further, the toner adherence amount judge and converter 114 calculates the clear toner adherence amount Vt' the image forming apparatus 1 transfers to a paper, based on the following formula (STEP S405).

$$Vt'=k(1-r)Vsumcol+rVt$$

Here, whether the clear toner adherence amount Vt' calculated in STEP S405 is not less than 0 is judged (STEP S406). When Vt' is judged to be not less than 0 in STEP S406, the toner adherence amount judge and converter 114 determines Vsumcol' calculated in STEP S405 as a total color toner adherence amount and Vt' calculated therein as a clear toner adherence amount, and completes the process. When Vt' is judged to be less than 0 in STEP S406, the toner adherence amount judge and converter 114 calculates Vsumcol', based on the following formula and determines Vt' as 0 (STEP S407).

$$Vsumcol'=r(Vsumcol+rVt)$$

Meanwhile, the clear priority k is judged to be greater than 0 in STEP S404, the toner adherence amount judge and converter 114 calculates Vsumcol' and clear toner adherence amount Vt', based on the following formulae, respectively (STEP S408).

$$Vsumcol'=rVsumcol-k(1-r)Vt$$

$$Vt'=(r+k-kr)Vt$$

Next, whether Vsumcol' calculated in STEP S408 is not less than 0 is judged (STEP S409). When Vsumcol' is judged to be not less than 0, the toner adherence amount judge and converter 114 determines Vsumcol' and Vt' calculated in STEP S408 as a color toner adherence amount and a clear toner adherence amount the image forming apparatus 1 transfers to a paper, respectively, and completes the process.

When Vsumcol' is judged to be less than 0 in STEP S408, the toner adherence amount judge and converter 114 determines Vsumcol' is 0 and Vt' based on the following formula (STEP S410).

$$Vt'=r(Vsumcol+Vt)$$

When the total color toner adherence amount Vsumcol' is determined as above, each of the color toner adherence amounts Vc', Vm', Vy' and Vk' is converted to have a same ratio as that of each of the Vc, Vm, Vy and Vk to Vsumcol, determined by the toner adherence amount determiner 113 and to have a total of Vsumcol'.

Next, the printer 12 forms an image, based on the color toner adherence amounts Vc', Vm', Vy' and Vk' and the clear toner adherence amount Vt' converted by the toner adherence amount judge and converter 114. The details are explained using FIG. 8.

First, the printer 12 forms a toner image on the surface of the photoreceptor drum 122 (STEP S51). Specifically, the charger 123 contacts the photoreceptor drum 122 and applies a voltage thereto to charge the surface of the photoreceptor drum 122. A laser beam emitted from an unillustrated irradiator forms an electrostatic latent image on the surface of the photoreceptor drum 122, based on the color toner adherence amounts Vc', Vm', Vy' and Vk' and the clear toner adherence amount Vt' determined by the toner adherence amount determiner 113. The image developer 124 transfers a toner contained in the cartridge 121 to the electrostatic latent image formed on the surface of the photoreceptor drum 122 to form a toner image thereon.

Next, the intermediate transfer belt 125 travels while contacting the photoreceptor drum 122, and the toner image formed thereon is first transferred onto the intermediate transfer belt 125 (STEP S52). The toner having an adherence amount converted by the toner adherence amount judge and converter 114 adheres to the intermediate transfer belt 125. After the toner image is first transferred onto the intermediate transfer belt 125, the surface of the photoreceptor drum 122 is discharged by a discharger. An untransferred toner remaining on the surface of the photoreceptor drum 122 is removed by a cleaner.

Then, the intermediate transfer belt 125 the toner image is first transferred on travels to the second transfer roller 126. Meanwhile, the paper feed roller 132 takes out a paper contained in the paper feed tray 131 and put the paper into the registration roller 134. The registration roller 134 sends the paper between the intermediate transfer belt 125 and the second transfer roller 126. The toner image on the surface of the intermediate transfer belt 125 is secondly transferred onto the paper while sandwiched therebetween (STEP S53).

After the toner image is secondly transferred onto the paper in STEP S53, the pressure roller 1271 of the fixer 127 presses the paper to the fixing belt 1272 with heat to fix the toner image on the paper (STEP S54). Finally, the paper discharger 15 discharges the paper the toner image is fixed on onto a paper discharge tray (STEP S55).

In the present invention, the transceiver 111 receives image information transmitted from image processors, etc. through a communication network. The read sensor 142 of the scanner 14 may receive the image information obtained from documents, etc. placed on the contact glass 141.

In addition, under color removal converter 1132 may not perform under color removal conversion, and the toner adherence amount judge and converter 114 may calculate the color toner adherence amount and the clear toner adherence amount transferred by the image forming apparatus 1, based on the adherence amounts VcO, VmO and VyO converted by the image information converter 1131.

Further, the transceiver 111 receives clear priority information transmitted from image processors, etc., and may receive clear priority information entered by a user through an input device, e.g., the operation display panel 107 in the image forming apparatus 1.

What is claimed is:

1. An image forming apparatus which transfers clear toner and at least one of cyan, magenta, yellow, and black color toner onto a recording medium to form an image based on image information and image classification information, the apparatus comprising:

a clear priority determiner configured to determine a clear priority based on the image classification information;

a toner adherence amount determiner configured to determine amounts of the color toners and the clear toner to be adhered to the recording medium based on the image information and the clear priority; and a toner transferer configured to transfer the color toners and the clear toner onto the recording medium in amounts determined by the toner adherence amount determiner, wherein the toner adherence amount determiner determines the amounts of the color toners and the clear toner to be adhered to the recording medium based on the clear priority determined by the clear priority determiner and a regulated value which is a predetermined maximum total adherence amount of the color toners and the clear toner.

2. The image forming apparatus of claim 1, further comprising a memory configured to correlate the image classification information and the clear priority and store the correlated image classification information and clear priority.

3. The image forming apparatus of claim 1, further comprising an information receiver configured to receive the image information and the image classification information, wherein the clear priority determiner determines the clear priority based on the image classification information received by the information receiver, and the toner adherence amount determiner determines the amounts of the color toners and the clear toner to be adhered to the recording medium based on the image information received by the information receiver.

4. The image forming apparatus of claim 1, wherein the clear priority is a value selected from a continuum of values.

5. The image forming apparatus of claim 1, wherein the clear priority is a real number of from −1 to 1, and wherein the amount of the clear toner to be adhered to the recording medium when the clear priority is a negative value is less than when the clear priority is a positive value.

6. The image forming apparatus of claim 1, wherein the clear priority is a real number of from −1 to 1, and wherein the amount of the color toners to be adhered to the recording medium when the clear priority is a negative value is more than when the clear priority is a positive value.

7. An image forming method that transfers clear toner and at least one of cyan, magenta, yellow, and black color toner onto a recording medium to form an image based on image information and image classification information, the method comprising:

determining a clear priority, based on the image classification information;

determining amounts of the color toners and the clear toner to be adhered to the recording medium based on the image information and the clear priority; and transferring the color toner(s) and the clear toner onto the recording medium in amounts determined in the determining of the amounts of the color toners and the clear toner to be adhered to the recording medium, wherein the determining of the amounts of the color toners and the clear toner determines the amounts of the color toners and the clear toner to be adhered to the recording medium based on the clear priority determined by the clear priority determiner and a regulated value which is a predetermined maximum total adherence amount of the color toners and the clear toner.

8. An image forming apparatus which transfers clear toner and at least one of cyan, magenta, yellow, and black color toner onto a recording medium to form an image based on image information and image classification information, the apparatus comprising:

a clear priority determiner configured to determine a clear priority based on the image classification information;

a toner adherence amount determiner configured to determine amounts of the color toners and the clear toner to be adhered to the recording medium based on the image information and the clear priority; and a toner transferer configured to transfer the color toners and the clear toner onto the recording medium in amounts determined by the toner adherence amount determiner, wherein the clear priority is a real number of from −1 to 1, and wherein the amount of the clear toner to be adhered to the recording medium when the clear priority is a negative value is less than when the clear priority is a positive value.

* * * * *